US005605491A

United States Patent [19]

Yam et al.

[11] Patent Number: 5,605,491

[45] Date of Patent: Feb. 25, 1997

[54] BLAST MEDIA WITH DEFOAMERS

[75] Inventors: Benny S. Yam, Holmdel; Andrew Logan, East Windsor, both of N.J.

[73] Assignee: Church & Dwight Co., Inc., Princeton, N.J.

[21] Appl. No.: 458,662

[22] Filed: Jun. 2, 1995

[51] Int. Cl.[6] ..... B24B 1/00

[52] U.S. Cl. ..... 451/40; 451/38; 451/39; 451/75; 451/87; 451/88

[58] Field of Search ..... 451/38, 39, 40, 451/75, 87, 88, 89, 91

[56] References Cited

U.S. PATENT DOCUMENTS

| | | | |
|---|---|---|---|
| 4,478,368 | 10/1984 | Yie | 239/430 |
| 4,545,155 | 10/1985 | Nakata | 51/320 |
| 4,548,617 | 10/1985 | Miyatani et al. | 51/293 |
| 4,585,648 | 4/1986 | Maeyama et al. | 424/49 |
| 5,384,990 | 1/1995 | Spears, Jr. | 451/40 |
| 5,512,071 | 4/1996 | Yam et al. | 451/40 |

*Primary Examiner*—Willis Little
*Assistant Examiner*—Eileen Morgan
*Attorney, Agent, or Firm*—Irving M. Fishman

[57] ABSTRACT

A blast media for use in wet blasting to clean contaminants from a substrate surface comprises abrasive particles, at least one surfactant and a defoaming agent so as to reduce the amount of foam which is produced during the wet blasting process.

35 Claims, No Drawings

BLAST MEDIA WITH DEFOAMERS

FIELD OF THE INVENTION

The present invention relates to improvements in wet blasting to remove adherent materials such as paint, scale, dirt, grease, oil and the like from solid surfaces, in particular, when utilizing a water soluble alkaline salt abrasive.

BACKGROUND OF THE INVENTION

In order to clean a solid surface to preserve metal against deterioration, remove graffiti from stone or simply to degrease or remove dirt or other coatings from a solid surface, it has become common practice to use an abrasive blasting technique wherein abrasive particles are propelled by a fluid against the solid surface in order to dislodge the previously applied coatings, scale, dirt, grease or other contaminants. Such abrasive blasting has been used favorably, for example, to degrease metal and is being increasingly used as a replacement for the environmentally hazardous solvent cleaning treatments.

Various abrasive blasting techniques have been used to clean a surface including dry blasting which involves directing the abrasive particles to the surface by means of pressurized air, wet blasting in which the abrasive blast media is directed to the surface by a pressurized stream of water, and a process in which both air and water are utilized either in combination at sufficient pressures to propel the abrasive blast media to the surface as disclosed in U.S. Pat. No. 4,817,342, or in combination in which relatively low pressure water is used primarily as a dust control agent or to control substrate damage.

The blast media or abrasive particles most widely used for blasting surfaces either by dry or wet blasting to remove adherent material therefrom is sand. Sand is a hard abrasive which is very useful in removing adherent materials such as paint, scale and other materials from metal surfaces such as steel. While sand is a most useful abrasive for each type of blasting technique, there are disadvantages in using sand as a blast media. For one, sand, i.e., crystalline silica, is friable and upon hitting a metal surface will break into minute particles which are small enough to enter the lungs. These minute silica particles pose a substantial health hazard. Additionally, much effort is needed to remove the sand from the surrounding area after completion of blasting. Still another disadvantage is the hardness of sand itself. Thus, sand cannot be readily used as an abrasive to remove coatings from relatively soft metals such as aluminum, or non-metallic substrates such as plastic, plastic composite structures, concrete or wood, as such relatively soft substrates can be excessively damaged by the abrasiveness of sand. Moreover, sand cannot be used around moving parts of machinery inasmuch as the sand particles can enter bearing surfaces and the like.

An alternative to sand as a blast media, particularly, for removing adherent coatings from relatively soft substrates such as softer metals as aluminum, or plastic composite surfaces and the like is sodium bicarbonate. While sodium bicarbonate is softer than sand, it is sufficiently hard to remove coatings from any metal surface and as well remove coatings including paint, dirt, and grease from non-metallic surfaces without harming the substrate surface. Sodium bicarbonate is not harmful to the environment and is most advantageously water soluble such that the particles which remain subsequent to blasting can be simply washed away without yielding environmental harm. Since sodium bicarbonate is water soluble and is benign to the environment, this particular blast media has found increasing use in removing coatings and cleaning dirt, grease and oil and the like from metal and a variety of other surfaces.

Sodium bicarbonate is also a friable abrasive and, like sand, will form a considerable amount of dust during the blast cleaning process. To control the dust formed by the sodium bicarbonate blast media as it contacts the targeted surface, water has been used as the pressurized fluid stream to carry the sodium bicarbonate particles to the target surface or included in the compressed air carrier medium either internally in the nozzle or directed as an external stream onto or surrounding the stream of the abrasive particles for dust control. Each of these processes is considered wet blasting.

Various techniques are known for introducing a particulate abrasive into a water stream, for example, by introduction of a separate air stream which carries the particulate abrasive into the throat of a venturi-type blast nozzle through which the water carrier is passing, or by mixing the particulate abrasive/air stream exterior of a blast nozzle means with the liquid-stream as disclosed in U.S. Pat. No. 4,125,969. For convenience of operation, the particulate abrasive and water have conventionally been allowed to mix while traveling through the interior of the blast nozzle which is used to direct the abrasive/water mixture to the work surface at high velocity.

While water soluble abrasive media such as sodium bicarbonate is finding increasing use in the cleaning industry as a blast media for cleaning metals such as steel and, in particular, softer metals such as aluminum, copper, brass, etc. and softer non-metallic substrates such as plastic, plastic composites, wood, concrete, etc., due to the fact that the sodium bicarbonate blast media is safe to use, safe for the environment, and provides a relatively easy clean-up from the work site, upon wet blasting and subsequent drying of the target surface, there can remain a film of the sodium bicarbonate media which remains on the surface of the substrate. Even after rinsing the substrate with water, this residue can remain leaving an unsightly film on the clean surface or provide the surface with a dull finish. In U.S. Pat. Nos. 5,308,403 and 5,316,587, both of which are herein incorporated by reference, and assigned to Church & Dwight Co., a rinse aid is mixed with the sodium bicarbonate blast media to effect removal of this residual film during wet blasting and rinsing. The rinse aid can be a surfactant, magnesium oxide or a combination thereof. The addition of the rinse aid has been very effective for greatly reducing if not eliminating the residue of sodium bicarbonate blast media which remains on a clean surface, especially flat surfaces subsequent to wet blast cleaning.

The amount of surfactant used to provide reduced residue content and easily rinsed residues is extremely small in most cases and, thus, typically ranges from about finite levels to about 3 wt. %, preferably about 0.05 to about 1 wt. %, and, more preferably, from about 0.05 to 0.5 wt. % of the abrasive blast media particles. Moreover, the addition of the surfactant actually aids in removing any dirt, grease or oil from the substrate. Nonionic surfactants appear to best provide the additional detersive action. Surfactant levels provided to aid in removing any dirt, grease or oil from the substrate can be much higher and, thus, range from about 0.1 to 30 wt. % relative to the blast media. Thus, it is useful to provide several kinds of surfactants with the blast media including those most readily able to reduce residue formation such as anionic surfactants and those capable of enhancing the removal of dirt, grease or oil from the substrate. The surfactant advantageously solubilizes the dirt and grease allowing easier clean up and reduces the deflection of dirt from one surface to another.

The addition of surfactant to water soluble abrasive blast media such as sodium bicarbonate has been very helpful in removing residual films of the abrasive during wet blasting and to enhance the cleaning effect of the abrasive media. Unfortunately, during wet blasting, even minute amounts of the surfactant can cause excessive foaming in the effluent. The presence of foam can make the effluent more difficult to contain and dispose of. Further, it has recently been suggested to use a slurry blasting process in which sodium bicarbonate abrasives are dispersed in a relatively low pressure water stream and directed against the targeted surface which is situated in a blast cabinet. The used slurry can be recycled and again directed at the substrate surface. Excessive foaming in the blast cabinet causes overflow of slurry which is to be recycled and decreases pumping efficiency during the recycling process.

Accordingly, it would be useful to incorporate a surfactant into an abrasive blast media whether to aid in the rinsing of residual films of the abrasive left on the substrate surface after cleaning or to aid in the removal of the contaminants from the surface and be able to reduce the amount of foam which is produced during wet blasting of such blast media.

It is, therefore, a primary objective of the present invention to reduce the amount of foam produced during the wet blasting of an abrasive media which further contains a surfactant.

Another objective of the present invention is to provide a blast media which comprises abrasive particles, a surfactant and an agent which reduces the amount of foam produced during the wet blasting of the media on a target surface for the removal of contaminants therefrom.

These and other objects of the invention will become readily apparent upon a review of the description of the invention below and the appended claims.

SUMMARY OF THE INVENTION

In accordance with the present invention, an improved blast media is provided for use in removing contaminants from a surface by a wet blasting process. In particular, the blast media of the present invention comprises solid abrasive particles, a surfactant and a defoaming agent. The defoaming agent can be in the form of a solid and mixed with the abrasive particles and surfactant as a free-flowing mixture or the defoaming agent can be a liquid which is sprayed onto the abrasive particles or any other solid carrier which can be mixed with the abrasive.

The abrasive blast media of this invention including surfactant and defoaming agent is particularly useful in any wet blasting process in which water is added to the abrasive stream. In particular, the abrasive blast media of the present invention is useful in a slurry blasting process in which the abrasive particles are dispersed in a water stream and directed to the substrate which is situated within a blast cabinet structure and in which the spent slurry is recycled for redirection against the target substrate. The addition of the defoaming agent to the blast media greatly reduces the amount of foam produced in such process and prevents the problem of foam spillage from the cabinet and pump cavitation during the recycle of the spent slurry.

DETAILED DESCRIPTION OF THE INVENTION

The abrasive particles to be utilized in the blast media and dispersed within the pressurized fluid stream for wet blasting are preferably water soluble. The abrasive typically will be in the form of a powder having an average size range of from about 10 to 1,000 microns in diameter. Preferably, the abrasive particles will have an initial average size of from about 50–500 microns, more preferably from about 100 to 300 microns. The amount of abrasive particles having a size of greater than 1,000 microns in diameter is preferably less than 1% of the abrasive particles. Upon optional recycle and reuse, the particles will typically have a size of at least about 15 microns. Water soluble abrasive particles are advantageous since such blast media can be readily disposed of by a water stream, are readily separated from the insoluble paints, resins, grease oils, etc. which have been stripped from the contaminated surface to facilitate waste disposal, and since most water soluble blast media are relatively soft, i.e., Mohs hardness less than 4.0, such media can be utilized to remove coatings, grease, dirt and the like from a variety of substrates including hard metals such as steel and, importantly, relatively soft metals such as aluminum, copper, brass, zinc and the like. Further, nonmetals such as plastics, ceramics, concrete, wood and composites of such materials can be effectively treated using water soluble abrasives. Water soluble alkaline salt blast media having a Mohs hardness of less than 5.0 are generally useful in this invention, in particular, for cleaning softer substrates. The blast media may further contain insoluble abrasives such as sand, alumina, glass beads, steel shot, calcium carbonate, etc. to improve efficacy of cleaning, especially if the object to be cleaned is grossly contaminated and if the surface is hard enough to withstand the blast cleaning process using the harder abrasives. The insoluble abrasives used in admixture with the water soluble abrasives of this invention can be provided in amounts of 1 to 50 wt. % relative to the total abrasive used. Although not preferred, the blast media of this invention can be wholly comprised of the hard, water insoluble abrasives such as those listed above.

Non-limiting examples of water soluble abrasives which can be utilized in the blast media of this invention include alkali metal salts of the chlorides, chlorates, carbonates, bicarbonates, sesquicarbonates, sulfates, silicates, the hydrates of the above, etc. The preferred abrasive particles are sodium and potassium carbonates, bicarbonates, sesquicarbonates and sulfates. The most preferred abrasive to be incorporated into the blast media are the alkali metal bicarbonates as exemplified by sodium bicarbonate. Such a bicarbonate-based blast media is marketed under the tradename ARMEX® by Church & Dwight Co., Inc., Princeton, N.J. Also preferably useful are sodium sesquicarbonate and natural sodium sesquicarbonate known as trona. Also useful are sodium chloride and sodium sulfate which latter sodium salt is described in commonly assigned U.S. Pat. No. 5,112,406. It is important to note that by water soluble is not meant completely water soluble as some salts and natural minerals such as trona may contain minor amounts of insoluble materials. For example, trona which is a natural sodium sesquicarbonate may contain up to 10 wt. % of insolubles. Thus, by water soluble is meant to include those materials which are substantially soluble in water.

To reduce residues of the blast media from remaining on the substrate surface and/or to aid in the removal of contaminants from the substrate surface, the blast media of the present invention has at least one surfactant incorporated therein. The surfactant which may be utilized can be anionic, nonionic or amphoteric in nature or mixtures of the various types of surfactant can be used.

Anionic surfactants appear to best reduce the residue formation of water soluble blast media components. Moreover, since many of the anionic surfactants are solids, such surfactants can be simply added as is to the blast media without causing any adverse caking and lumping problems. Examples of suitable anionic surfactants are water-soluble salts of the higher alkyl sulfates, such as sodium lauryl sulfate or other suitable alkyl sulfates having 8 to 18 carbon atoms in the alkyl group, water-soluble salts of higher fatty acid monoglyceride monosulfates, such as the sodium salt of the monosulfated monoglyceride of hydrogenated coconut oil fatty acids, alkyl aryl sulfonates such as sodium dodecyl benzene sulfonate, higher alkyl sulfoacetates, higher fatty acid esters of 1,2-dihydroxy propane sulfonate, and the substantially saturated higher aliphatic acyl amides of lower aliphatic amino carboxylic acid compounds, such as those having 12 to 16 carbons in the fatty acid, alkyl or acyl radicals, and the like. Examples of the last mentioned amides are N-lauroyl sarcosinate, and the sodium, potassium, and ethanolamine salts of N-lauroyl, N-myristoyl, or N-palmitoyl sarcosinate sold by W.R. Grace under the tradename "Hamposyl". Also effective are polycarboxylated ethylene oxide condensates of fatty alcohols manufactured by Olin under the tradename of "Polytergent CS-1".

Amphoteric surfactants are a well known class of surfactants which includes the alkyl beta-iminodipropionates $RN(C_2H_4COOM)_2$ and the alkyl beta-aminopropionates $RNHCH_4COOM$ where the alkyl group R contains 8 to 18 carbon atoms in both formulae and M is a salt-forming cation such as the sodium ion. Further examples are the long chain imidazole derivatives, for example, the di-sodium salt of lauroyl-cycloimidinium-1-ethoxy-ethionic acid-2-ethionic acid, and the substituted betaines such as alkyl dimethyl ammonio acetates where the alkyl group contains 12 to 18 carbon atoms. N-alkyl-2-pyrrolidones which are highly polar apiotic solvents, are also surface active and can be used. "Surfadone LP-100" from International Specialty Products has been found particularly useful.

Suitable non-ionic surfactants include the polyoxyethylene-polyoxypropylene condensates, which are sold by BASF under the tradename "Pluronic", polyoxyethylene condensates of alkyl phenols; polyoxyethylene condensates of aliphatic alcohols/ethylene oxide condensates having from 1 to 30 moles of ethylene oxide per mole of coconut alcohol; ethoxylated long chain alcohols sold by Shell Chemical Co. under the tradename "Neodol", polyoxyethylene condensates of sorbitan fatty acids, alkanolamides, such as the monoalkoanolamides, dialkanolamides and the ethoxylated alkanolamides, for example coconut monoethanolamide, lauric isopropanolamide and lauric diethanolamide; and amine oxides for example dodecyldimethylamine oxide.

The surfactants useful in the blast media of the present invention can be incorporated with abrasive in a variety of ways. If solid, the surfactant can be mixed as is with the abrasive blast media particles. This is preferred and it has been found that the most useful surfactants for reducing residue formation are anionic surfactants, many of which are solid materials.

If the surfactant is liquid, the surfactant can be sprayed directly onto the blast media particles. While this method is the most direct way of incorporating the surfactant, the flow of the blast media through the metering means which meters the amount of abrasive particles into the fluid carrier stream may be adversely affected by incorporating the surfactant in this manner. Thus, the very fine particles of blast media may agglomerate and otherwise cake or bridge together and render particle flow through a metering device difficult. Alternatively, the liquid surfactant can be sprayed onto the blast media particles, the coated blast media particles compacted and the compacted product which is formed regranulated into a surfactant-containing solid. Compacting may be performed by applying pressure to the surfactant-coated abrasive particles such as by continuously admitting the coated abrasive particles to a zone where the coated particles are subjected to pressure between two rolls running oppositely with respect to each other. A preferred means of compacting is by a roller compactor, wherein the particles are subjected to pressure between two rolls under an adjustable compacting pressure. An especially preferred compactor is the Fitzpatrick Co. "Chilsonater" roll compactor. The gap between the rolls, the amount of raw materials introduced to such a roll compactor and the compacting pressure can be adjusted to produce cohesive sheets or pellets of desired density and hardness. The sheets or pellets are then regranulated by any suitable granulating or crushing means. Preferably, the compacted sheets, pellets and the like are fed through a sieve crusher to force the compacted material through a sieve with meshes of a given size determining the particle size of the final product. Screening, if desired, can be performed by any suitable screening device.

Still further, the surfactant can be sprayed directly onto the abrasive blast media particles and the surfactant-coated particles then dusted with a very finely divided material to reduce the caking and bridging between the abrasive particles. Thus, finely divided fume silica, silicates such as clays, talc, mica, diatomaceous earth and metal silicates such as aluminosilicates including zeolites may be used for dusting the liquid surfactant-coated abrasive. Obviously, the addition of a significant amount of water insoluble additives reduces the advantages of the water solubility of the abrasive blast media with respect to disposal. Preferably, therefore, the amount of dusting agent should be minimized. Inasmuch as the amount of surfactant to be included is minute, likewise the amount of the dusting agent required to maintain free-flow of the blast media should also be minimal.

Still another method of incorporating the surfactant in the blast media is to apply the surfactant to solid carrier particles similar to those described above. Thus, fume silica, various silicates can be utilized as the carrier particles including clays such as kaolin clay, talc, mica, aluminosilicates such as zeolites.

Further, the surfactant can be added to any flow aids which are normally contained in blast media compositions by coating such materials prior to incorporation thereof with the abrasive particles. Such flow aids reduce caking of the water soluble blast media and can include the carrier materials described above. Most preferably, the flow aid is a hydrophilic or hydrophobic silica, hydrophobic polysiloxane or mixture of such materials. These flow aids are typically added in amounts of 0.05 to 2%, preferably about 0.1 to 0.5% by weight relative to the total of abrasive particles. Hydrophobic silica, unlike known hydrophilic silicas, is substantially free of non-hydrogen bonded silanol group and absorbed water. One preferred hydrophobic silica which may be utilized in the blasting media hereof is Aerosil R 972, a product which is available from DeGussa AG. This material is a pure coagulated silicon dioxide aerosol, in which about 75% of the silanol groups on the surface thereof are chemically reacted with dimethyldichlorosilane, the resulting product having about 0.7 mmol of chemically combined methyl groups per 100 $m^2$ of surface area and containing about 1% carbon. Its particles vary in diameter from about 10 to 40 nanometers and have a specific surface area of about 110 $m^2$/gram. It may be prepared by flame hydrolysis of a hydrophilic silica as more fully described in Angew. Chem., 72, 744 (1960); F-pS 1,368,765; and DT-AS 1,163,784. Further details respecting such material are contained in the technical bulletin entitled "Basic Characteristics and Applications of AEROSIL", DeGussa AG, August 1986. The hydrophobic silica particles are admixed with the abrasive blasting media in the proportion of at least about 0.1 and up to about 1.0% by weight thereof. Another hydrophobic silica is Quso, marketed by DeGussa A.G.

Hydrophobic polysiloxanes, preferably non-halogenated polysiloxanes, suitable for use in the blasting media hereof are commercially marketed by Dow Corning and General Electric.

An alternative to adding the surfactant to any of the solid materials which form the blast media is to add the surfactant to the water which is utilized as the primary fluid carrier medium or as a dust control agent. Thus, the surfactant can be added at the supply of water or can be added to the water stream at the blast nozzle.

The amount of surfactant used to provide reduced residue content and easily rinsed residues is extremely small in most cases and, thus, typically ranges from about finite levels to about 3 wt. %, preferably about 0.05 to about 1 wt. %, and, more preferably, from about 0.05 to 0.5 wt. % of the abrasive blast media particles. Moreover, the addition of the surfactant actually aids in removing any dirt, grease or oil from the substrate. Nonionic surfactants appear to best provide the additional detersive action. Surfactant levels provided to aid in removing any dirt, grease or oil from the substrate can be much higher and, thus, range from about 0.1 to 30 wt. % relative to the blast media. Thus, it is useful to provide several kinds of surfactants with the blast media including those most readily able to reduce residue formation such as anionic surfactants and those capable of enhancing the removal of dirt, grease or oil from the substrate. The surfactant advantageously solubilizes the dirt and grease allowing easier clean up and reduces the deflection of dirt from one surface to another.

Unfortunately, upon the addition of a surfactant to an abrasive blast media, foaming occurs during the wet blasting of the media on a targeted surface even if minute amounts of surfactant are utilized such as for the purpose of reducing the amount of residue which remains on the substrate from a water soluble abrasive media. Accordingly, the blast media of the present invention also includes a defoaming agent for the purpose of reducing if not eliminating the amount of foam which is formed during wet blasting.

As with the addition of the surfactant, the defoaming agent can be incorporated into the blast media of the present invention as a solid or as a liquid. A solid defoaming agent is particularly preferred due to its ease of handling and ability to be readily mixed with the abrasive to form a blast media. Liquid defoaming agents can be added to the abrasive media such as by spraying the defoaming agent on the abrasive media or any inert particles which are added to the abrasive media or included in any liquid stream which is used during the wet blasting process. Many defoaming agents are known and selecting a particular defoaming agent will depend upon its compatibility with the particular abrasive used and with the particular surfactant or mixture of surfactants which are included in the blast media. General types of defoaming agents are described in Vol. 7, pages 928–941, from the *Kirk-Othmer Encyclopedia of Chemical Technology,* Fourth Edition, the contents of which passage are herein incorporated by reference. Specific types of defoaming agents which can be included in the blast media of the present invention include insoluble particulate materials, such as hydrophobic (silicone-treated) silica, fatty amides, hydrocarbon waxes, fatty acids and fatty esters.

Examples of silicone antifoam agents include Antifoam A Compound (Dow Corning), Midland, Mich.; Burst RSD-30 (Hydrolabs), Albemarle, N.C.; Antifoam 100 (Harcros Chemicals Inc.), Kansas City, Kans. Non-silicone antifoam agents include Antifoam HL-23 (Harcros Chemical Inc.) and Burst JSF (Hydrolabs).

The amount of defoamer added will again vary depending upon the amount of surfactant included into the blast media as well as the type of surfactant and type of defoaming agent utilized. Generally, however, the amount of active defoaming agent added to the blast media will comprise from about 1 to 100 wt. % based on surfactant and, generally, smaller amounts are utilized ranging from about 1 to 30 wt. % based on the amount of surfactant.

Further agents which enhance cleaning efficacy or provide a post-treatment to the target surface can be added to the blast stream by direct addition to the aqueous stream or added to the blast media particles. For example, soluble alkaline salts can be added to the aqueous solution to increase solution pH or act as builder salts to improve removal of soil, greases, oils, etc. from the substrate being cleaned. Such salts can include alkali metal carbonates, bicarbonates, the hydrates thereof, sesquicarbonates, ortho or complex phosphates such as pyrophosphate, tripolyphosphate as well as the alkali metal borates, acetates, citrates, tartrates, gluconates, succinates, silicates, nitrilotriacetates, edates, etc. Corrosion inhibitors can be added including alkali metal phosphates, phosphonates, benzotriazoles, etc.

To further enhance the removal of residues of the blast media which remain on the substrate surface subsequent to wet blasting, it may be useful to incorporate magnesium oxide particles with the abrasive particles. A blast media containing magnesium oxide particles for a rinse aid is disclosed in aforementioned, commonly assigned U.S. Pat. No. 5,308,403. The size of the magnesium oxide particles to be incorporated into the blast media should be small enough to maximize surface area. Magnesium oxide particles are at most about 20 microns in diameter are useful. Preferably, MgO particles having an average diameter of less than about 10 microns are used. The magnesium oxide particles should be used in amounts from about 0.05 to 3% by weight of the blast media, preferably, from about 0.1 to 1 wt. % to achieve effective residue reduction.

More particularly related to the wet blasting process for directing the blast media of this invention to a targeted surface, as the preferred abrasive particles of the blast media of the present invention are water soluble, the addition of such particles into a pressurized fluid stream comprising water for projection onto a targeted surface can often reduce the abrasive nature of the particles. Thus, it is preferred in accordance with the wet blasting process of the present invention that the pressurized aqueous stream which carries the abrasive particles comprise a saturated solution and the blast stream comprise a slurry formed of the abrasive particles and the saturated aqueous solution. This process is described in commonly assigned U.S. Pat. No. 5,384,990 and copending U.S. application Ser. No. 370,801 filed Jan. 10, 1995.

In accordance with the wet blasting processes disclosed therein, any of the liquid streams which carry the abrasive particles can comprise a saturated solution. Preferably, the saturated solution is formed from dissolved abrasive material. The saturated solution forming the liquid carrier insures that the abrasive particles which are added to the carrier liquid to enhance the abrasive nature thereof do not readily dissolve and retain the geometry and abrasive nature thereof during the blast cleaning process. Thus, all of the liquid streams which contain the abrasive particles preferably comprise saturated solutions including any liquid stream which carries the abrasive particles from the source of supply to the primary particle accelerator stream as well as the liquid accelerator stream which is mixed prior to the nozzle with the particulate abrasive or directed separately to the nozzle and mixed with abrasive particles at the nozzle prior to being directed to the targeted surface. If the liquid accelerator stream is provided separately to the blast nozzle, the abrasive particles can be added to this liquid stream by aspiration, by means of compressed air or by admixture in a slurry in which the liquid carrier for the supply of abrasive particles is also a saturated solution so as to minimize dissolution of the abrasive particles from the supply source. Preferably, the abrasive particles are mixed with a saturated solution prior to the nozzle and this slurry is pumped to sufficient pressure such as by a piston driven positive displacement pump to the nozzle apparatus and subsequently to the targeted surface.

The liquid accelerator stream is preferably water although other liquids can be utilized. For example, glycerin has been utilized as a carrier fluid in blasting operations and is useful since it tends to maintain an even distribution of the particulates therein relative to water in which the particulates tend to settle out. Other water soluble polymeric materials can be used as the carrier liquid or, preferably, as an additive to water to affect the viscosity, specific gravity or surface tension thereof. However, in view of the ease of use, expense with respect to the blast cleaning process and the clean-up of the spent media, water is preferred as the liquid carrier. With water as a carrier, the water soluble abrasive media described above can be used. For example, saturated solutions of sodium bicarbonate and water will comprise from about 7 to about 20% of the sodium bicarbonate depending upon the temperature of the water stream. If sodium carbonate or potassium carbonate are utilized as the blast media, substantially higher levels of these materials must be dissolved in the water stream to obtain a saturated solution. The relative dissolution of the abrasive media described above or other materials in water are readily obtainable from published literature. The water stream can alternatively be saturated with dissolved media other than the abrasive added to form the slurry. Thus, any soluble salt such as alkaline salts other than the abrasive can be added to the water carrier to form a saturated solution.

Once the liquid carrier stream or streams are saturated with the dissolved abrasive media or other salts, the abrasive media particles can be added therein to form a slurry with minimal dissolution of the added particles. The abrasive particles can be added by gravity as from a hopper, or carried to the saturated solution either by a compressed air stream or by admixture in a second saturated solution. The slurry is preferably formed prior to the blast nozzle as described above and pumped to the pressure required for blast cleaning. Alternatively, separate streams of the saturated liquid carrier and abrasive particles can be directed to the blasting apparatus and mixed therein prior to discharge to the targeted surface. The method of mixing the abrasive particles into the liquid carrier is not a critical feature of the invention.

The blasting equipment used in the wet blasting process of the present invention can be any of the conventional blasting equipment presently used. Examples include the blasting apparatus disclosed in U.S. Pat. No. 4,817,342 and U.S. Pat. No. 4,125,969. Typically, the wet blasting equipment comprises a venturi nozzle in which the pressurized fluid is accelerated by passage through a restricting orifice and directed to the targeted surface through an expanding outlet section of the nozzle. Usually, the venturi nozzle is a hand held device, although, automatic operation may be useful in some situations.

Various types of specific equipment can be used including high pressure water blasting equipment such as "Aqua-Dyne® high pressure water jet blaster" and "Dyna-Grip" wet abrasive blast system from Aqua-Dyne Incorporated, Houston, Tex. and "Aqua-Miser" blasting equipment for Carolina Equipment and Supply Company, Inc., North Charleston, S.C. which is described in U.S. Pat. No. 5,220,935 herein incorporated by reference. The above mentioned blasting apparatus mix the blast media particles entrained in a compressed air stream with a separate high pressure liquid stream. The liquid stream and particulate stream are mixed at the nozzle. Typically, such wet blasting equipment utilizes liquid pressures of at least about 500 psi and, more typically, greater than about 3,000 psi, even upward to about 40,000 psi.

Alternative equipment and processes can be used to add the abrasive to the liquid stream. For example, as previously stated, a slurry of the blast media particles and liquid carrier can be formed and pumped to the desired pressure prior to entering the blast nozzle. The slurry can also be pumped to an intermediate pressure and then directed to the venturi-type nozzle to increase pressure and velocity of the blast medium. Further alternatives include adding a slurry of blast media particles and liquid carrier to either a compressed air or pressurized water accelerator stream at the blast nozzle. As an example, the "Vapormatt" blast cleaning system from Kleiber and Schulz, Inc. Melville, N.Y., is a system wherein a slurry of insoluble abrasive in water is accelerated in a blast nozzle by compressed air. Such a system can be easily modified to form the slurry of an aqueous solution and a water soluble blast media as described above.

Instead of the high pressure Aqua-Dyne®, Aqua-Mixer and like blasting equipment described above, lower water pressure equipment are available and can be used to direct the slurry of water soluble blast media and aqueous solution to the targeted surface. Thus, it has been found that equipment for directing the slurry to the targeted surface at relatively low pressures below 500 psi and even below 125 psi are available or can be made and can effectively remove dirt, grease or any other contaminant contained on a solid surface. It is believed a system such as the "Vapormatt" cleaning system described above can be used at low slurry pressures. It has further been found that the presence of the abrasive in the slurry allows the blast cleaning to be accomplished effectively at low pressure and at relatively low temperatures such as room temperature. By contrast, currently available aqueous cleaning solutions such as for metal parts and the like require elevated temperatures approaching 190° F. to achieve effective cleaning. Thus, an alternative which allows the slurry to be blasted at low pressure and low temperature can be operated at reduced costs with respect to the specialized equipment needed for high pressure water blasting and over aqueous based cleaners which require high temperatures and consequently additional energy costs.

Other alternatives for directing the slurry of water soluble abrasive and saturated aqueous solution against a targeted surface are available and can be used in accordance with the present invention. Still further, the wet blasting process may be provided from a liquid (water) stream which is used for dust control. In this case the pressurized fluid stream is compressed air typically at pressures of from 30 to 150 psi which entrains the abrasive media and the water is added to or around the compressed air stream.

The blast media of the present invention is useful for efficient cleaning or decoating of sensitive metals such as aluminum or aluminum alloys, zinc, magnesium, copper, brass etc. Stainless steel, and other iron-containing surfaces can also be cleaned.

The structure of the surface to be cleaned can vary widely and is unlimited. Thus, the surface can be of complex configuration containing uneven profiles, with ridges, cavities, holes, etc. Further, the process of this invention is effective for cleaning sheets, coils, rolls, bars, rods, plates, discs, pipes, tubes, etc. Such articles can be derived from any source including for home use, industrial use such as from the aerospace industry, automotive industry or the electronic industry, etc.

The type of contaminant which can be removed from the substrates using the process of this invention is unlimited. In general, the process of this invention can be used to remove all types of contaminants including paint, rust, scale, greases, cutting fluids, drawing fluids, machine oils, anti-rust oils such as cosmolene, carbonaceous soils, sebaceous soils, particulate matter, waxes, paraffins, used motor oil, fuels, etc.

EXAMPLE 1

A blast media comprising sodium bicarbonate abrasive (ARMEX™ from Church & Dwight) and containing 0.1 wt. % of a nonionic surfactant and 0.1 wt. % of an anionic surfactant based on the weight of the abrasive particles is dispersed in water to form a slurry containing 30 wt. % solids. Added to the slurry is 0.016 wt. % based upon the weight of abrasive of a silicone-based defoaming agent, i.e., Antifoam 100, Harcros Chemicals, Inc. The amount of defoaming agent added is 8% of the surfactant in the blast media.

The slurry is directed from a conventional venturi-type round blast nozzle at a pressure of 50 psi toward the targeted substrate. The slurry is assisted to the substrate by additional air at a nozzle pressure of 80 psi. The targeted substrate is a dirty carburetor. At a slurry flow rate of about 3 gallons per minute, the dirty carburetor is cleaned in about 2 minutes. No sustaining foam is present of the substrate or the surrounding area.

EXAMPLE 2

A blast media is prepared comprising ARMEX™ sodium bicarbonate abrasive and 0.25 wt. % based on the bicarbonate abrasive of a nonionic surfactant. This blast media is then sprayed with 0.1 wt. % of a silicone-based antifoam agent, Antifoam A from Dow Corning to form a free flowing abrasive blast media power. The defoaming agent comprises 12 wt. % of the surfactant included in the blast media.

The blast media is directed to an epoxy painted steel sheet by an Accustrip™ machine from Church & Dwight. The blast nozzle which directs the blast media is also equipped with an external water atomizer which directs a spray of atomized water adjacent to the blast stream to control dust. The water atomizer operates with 40 psi water and 80 psi air. Air pressure at the blast nozzle for carrying the abrasive and directing same to the substrate is 60 psi. Flow rate of abrasive through the nozzle is 3 lbs per minute. During blasting, no sustainable foam is noticed either on the substrate surface or the surrounding area.

What is claimed:

1. A blast media for use in wet abrasive blasting of a targeted surface to remove contaminants therefrom comprises abrasive particles, at least one surfactant and a defoaming agent.

2. The blast media of claim 1 wherein said abrasives particles are water soluble.

3. The blast media of claim 2 wherein said abrasive particles comprise water soluble alkaline salts.

4. The blast media of claim 3 wherein said alkaline salts comprise alkali metal bicarbonates, alkali metal carbonates, alkali metal sesquicarbonates and alkali metal sulfates.

5. The blast media of claim 4 wherein said alkaline salt comprises sodium bicarbonate.

6. The blast media of claim 2 wherein said at least one surfactant comprises an anionic surfactant.

7. The blast media of claim 1 wherein said at least one surfactant comprises a nonionic surfactant.

8. The blast media of claim 2 wherein said at least one surfactant comprises a mixture of an anionic surfactant and at least one nonionic surfactant.

9. The blast media of claim 1 wherein said defoaming agent is present as a free-flowing solid particulate.

10. The blast media of claim 1 wherein said defoaming agent is a liquid.

11. The blast media of claim 10 wherein said defoaming agent is sprayed onto said abrasive particles.

12. The blast media of claim 1 wherein said defoaming agent is a silicone.

13. The blast media of claim 1 wherein said defoaming agent is a non-silicone-based compound.

14. The blast media of claim 13 wherein said defoaming agent is hydrocarbon based.

15. A process for wet blast cleaning a contaminated surface by directing against said surface a blast stream containing a pressurized fluid which contains water, abrasive particles, at least one surfactant and a defoaming agent.

16. The process of claim 15 wherein said abrasives particles are water soluble.

17. The process of claim 16 wherein said abrasive particles comprise water soluble alkaline salts.

18. The process of claim 17 wherein said alkaline salts comprise alkali metal bicarbonates, alkali metal carbonates, alkali metal sesquicarbonates and alkali metal sulfates.

19. The process of claim 18 wherein said alkaline metal salt comprises sodium bicarbonate.

20. The process of claim 16 wherein said at least one surfactant comprises an anionic surfactant.

21. The process of claim 15 wherein said at least one surfactant comprises a nonionic surfactant.

22. The process of claim 16 wherein said at least one surfactant comprises a mixture of an anionic surfactant and at least one nonionic surfactant.

23. The process of claim 15 wherein said defoaming agent is present as a free-flowing solid particulate.

24. The process of claim 15 wherein said defoaming agent is a liquid.

25. The process of claim 24 wherein said defoaming agent is sprayed onto said abrasive particles.

26. The process of claim 15 wherein said blast media is dispersed within said water to form a slurry.

27. The process of claim 26 wherein said slurry is directed against said contaminated surface at a water pressure of less than 500 psi.

28. The process of claim 27 wherein said slurry is directed against said contaminated surface at a water pressure of less than 125 psi.

29. The process of claim 27 wherein said contaminated surface is contained within an enclosed blast cabinet.

30. The process of claim 29 wherein subsequent to contact of the slurry with said contaminated surface, a spent slurry is recycled for redirection against a contaminated surface placed in said cabinet.

31. The process of claim 15 wherein said contaminated surface is metal.

32. The process of claim 26 wherein said defoaming agent is a free-flowing solid.

33. The process of claim 26 wherein said defoaming agent is a liquid.

34. The process of claim 33 wherein said defoaming agent is sprayed onto said abrasive particles.

35. The process of claim 33 wherein said defoaming agent is added separately to said slurry.

* * * * *